United States Patent [19]

Zeitz

[11] Patent Number: 4,950,102

[45] Date of Patent: Aug. 21, 1990

[54] WHEEL COMPACTION UNIT

[76] Inventor: James H. Zeitz, 27930 Kalmia Ave., Moreno Valley, Calif. 92360

[21] Appl. No.: 149,145

[22] Filed: Jan. 27, 1988

[51] Int. Cl.[5] ..... E01C 19/26

[52] U.S. Cl. ..... 404/121; 404/133; 301/125; 172/185

[58] Field of Search ..... 404/121, 123, 124, 128, 404/133; 301/109-111, 114, 125; 172/185, 540, 548, 601; 299/40

[56] References Cited

U.S. PATENT DOCUMENTS

| | | | |
|---|---|---|---|
| 1,624,734 | 4/1927 | Hunt | 404/121 |
| 1,668,142 | 5/1928 | Conger | 404/95 X |
| 1,802,556 | 8/1928 | Hendricks | 404/129 X |
| 2,131,947 | 10/1938 | Gilmore | 404/121 |
| 2,146,101 | 2/1939 | Weber | 404/121 |
| 2,176,984 | 10/1939 | Adkinson | 172/548 |
| 2,312,471 | 3/1943 | Low | 404/121 |
| 2,891,335 | 6/1959 | Linneman | 37/146 |
| 2,894,762 | 7/1959 | Randel | 301/125 X |
| 3,040,638 | 6/1962 | Atkinson | 404/121 |
| 3,168,767 | 2/1965 | Lutz | 404/121 X |
| 3,313,222 | 4/1967 | Barnum et al. | 404/121 |
| 3,318,209 | 5/1967 | Schultz | 404/121 |
| 3,370,653 | 2/1968 | Hixon | 172/185 X |
| 3,595,411 | 7/1971 | Ables | 404/121 X |
| 3,724,342 | 4/1973 | Caron et al. | 404/121 |
| 3,773,386 | 11/1973 | Soderlund | 299/40 |
| 3,822,957 | 7/1974 | Caron et al. | 404/121 |
| 3,891,342 | 6/1975 | Roe | 404/128 |
| 4,260,281 | 4/1981 | Sargent | 404/127 |
| 4,261,618 | 4/1981 | Davis | 299/40 X |
| 4,269,535 | 5/1981 | Schultz | 404/117 |
| 4,278,368 | 7/1981 | Livesay | 404/121 X |
| 4,381,874 | 5/1983 | Strader | 301/125 |
| 4,610,567 | 9/1986 | Hosking | 404/121 |
| 4,702,643 | 10/1987 | Thilmony | 404/121 |
| 4,723,870 | 2/1988 | Martinez | 404/121 |

*Primary Examiner*—Jerome W. Massie
*Assistant Examiner*—Gay Ann Spahn
*Attorney, Agent, or Firm*—Parmelee, Bollinger & Bramblett

[57] ABSTRACT

A wheel compaction unit for use on the articulated arm of heavy excavation equipment comprises a frame mounted to the equipment arm, the frame including support arms mounting a hub and axle assembly including three independently rotatable bearing mounted hubs. At least one compaction wheel is mounted to each hub, and auxiliary compaction wheels including angled spokes and an offset periphery are provided for mounting to the outside hubs to increase the working width of the wheel compaction unit. The hubs and axle assembly is sealed with ground metal seals and end plates. The periphery of the compaction wheels include spaced-apart presentation supports having angled leading/trailing edges, the presentation supports each supporting a compaction foot integral with the wheel. A removable wear collar closely surrounds the compaction foot and receives the primary impact and abrasion during use of the compaction unit, the wear collars being readily replaceable. A cutting wheel is alternatively mounted to the central hub for cutting pavement preparatory to excavation.

11 Claims, 6 Drawing Sheets

Fig. 4.
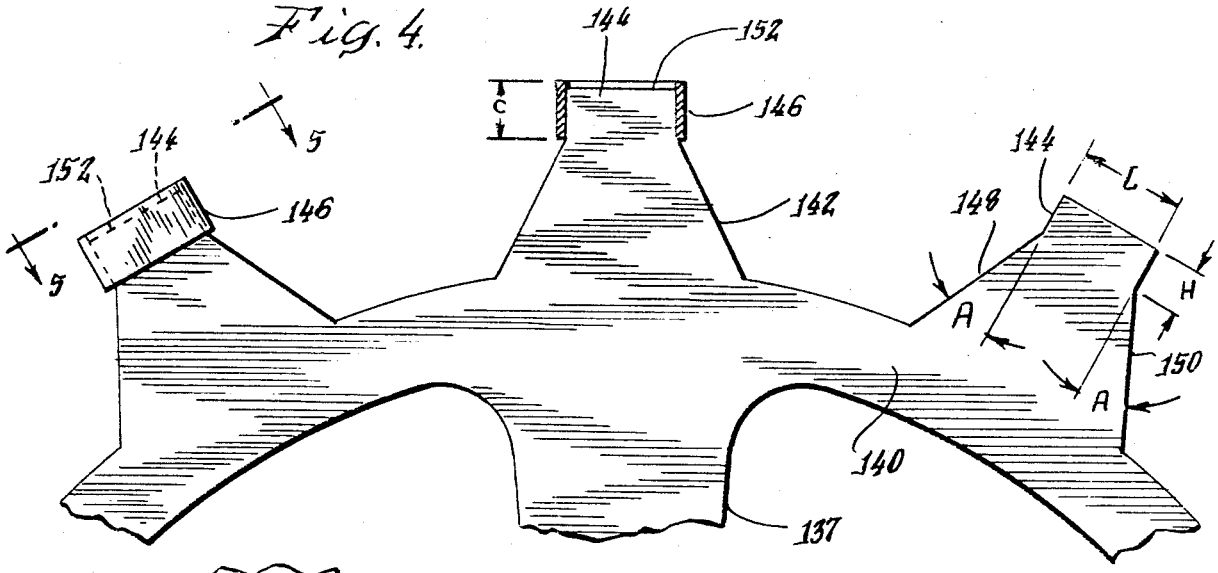
Fig. 5.
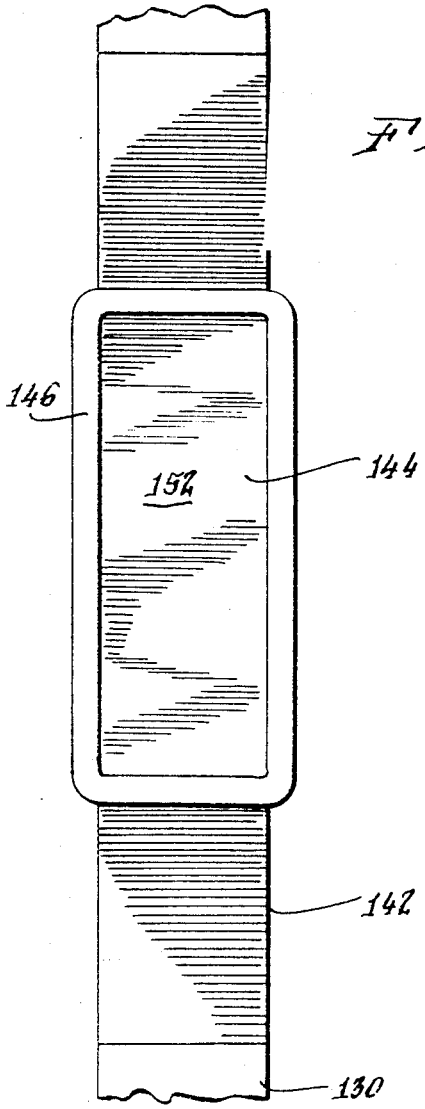
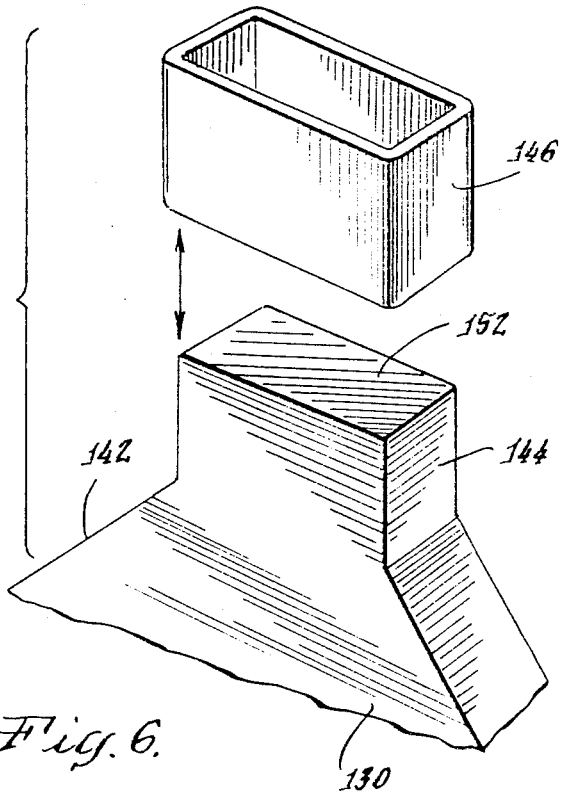
Fig. 6.

10
20
22
30
32
35
38
39
40
42
44
56
58
60
62
64
66
67
68
69
70
72
74
76
78
80
84
85
86
87
88
89
90
92
94
96
98
100
101
102
105
106
108
110
114
116
120
122
124
126
130
132
133
134
136
156
158
160
161
162
168
B

WHEEL COMPACTION UNIT

FILED OF INVENTION

The invention herein relates to a wheel compaction unit for use with heavy machinery in compacting loose fill, such as in refilling excavated pipe trenches. The invention herein further relates to a wheel compaction unit having replaceable wheel elements which include both compaction wheels and cutting wheels, the latter being useful in cutting pavement preparatory to excavation.

BACKGROUND OF INVENTION

Compacting devices are necessary for use in conjunction with refilling excavated sites. For example, when a trench is dug for the purpose of laying an underground pipeline and after the pipeline has been installed in the trench, it is necessary to fill the trench with the excavated soil. It is important that the surface of the ground be returned its original grade so that drainage patterns are not altered because of the excavation activity. This requires that the fill material placed in the trench be compacted to its original density in order to avoid settling over a period of time after the excavation crews and machinery have departed the site.

Compacting fill in trenches requires a great deal of pressure, and the pressure is conveniently applied by the excavating equipment of the type including a hydraulically-actuated articulated arm extending from a heavy chassis and engine vehicle. Thus, it is convenient to provide a compaction unit which mounts to the end of the articulated arm. Of course, it is desirable that a compaction unit operate efficiently in terms of the amount of time required to compact a given volume, particularly inasmuch as the cost and operation of the heavy excavating equipment is high. The compaction units are used in highly adverse conditions, being subjected to almost constant abrasion and impact. It is desirable that a compaction unit have longevity and require low maintenance, and preferably that basic maintenance be performable in the field. On occasion it is necessary to cut through pavement as a part of the excavating process, which is usually accomplished by either individual workmen with pneumatic hammers or by specialized cutting equipment. A compaction unit adaptable to this purpose would also be beneficial.

SUMMARY OF THE INVENTION

It is a principal object of the invention herein to provide a compaction unit suitable for efficient high pressure compaction of fill in excavated trenches and the like.

It is another object of the invention herein to provide a compaction unit which requires a minimum amount of time to complete compaction of a given volume of fill.

It is a further object of the invention herein to provide a compaction unit which has substantial longevity under adverse use conditions.

It is an additional object of the invention to provide a compaction wherein the wearable elements are adapted for replacement in the field.

It is yet another object of the invention to provide a wheel compaction unit which is adaptable to cut pavement preparatory to excavation.

A wheel compaction unit according to the invention herein comprises a frame adapted for mounting on and use with the hydraulicly actuated articulated arm of a heavy excavating machine. The wheel compaction unit frame includes a pair of arms which receive and support an axle, which is deployed horizontally in operation of the unit. Three oil-sealed, bearing-mounted hubs are independently rotatably supported on the axle, one of the hubs being positioned between the support arms and the other two hubs being positioned respectively on the portions of the axle extending outwardly from the arms. In a preferred embodiment, ground metal seals and a flange configuration defining a serpentine entry path protect the bearings from the ingress of dirt.

Each of the rotatable hubs mounts a compaction wheel having a plurality of spaced-apart compaction feet around the periphery thereof. More particularly, the periphery configuration is characterized by relatively short radially-extending compaction feet supported on triangular projections from a wheel circumference, wherein the triangular projections provide angled leading and trailing surfaces which cooperate in the compaction process and reduces the digging effect exhibited by longer compaction feet entering and exiting the fill. Each compaction foot is surrounded by a wear collar which also extends radially outwardly from the compaction foot, whereby the wear collar receives the impacts and abrasions of the compacting process. Thus, the underlying wheel, including its compaction foot, experiences very little wear and the wear collars can be readily replaced on the construction site with minimum down time.

The outer wheel hubs are each adapted to mount two compaction wheels, with the outside compaction wheels including angled spokes for offsetting their peripheries to provide spacing. Thus, the wheel compaction unit can be used to compact a variety of widths of excavated trenches, typically utilizing either three or five compaction wheels.

The center mounting hub preferably mounts a compaction wheel having a central opening larger than the outside mounting hubs, whereby the central compaction wheel can be mounted without disassembly of the mounting hubs. This feature also permits mounting of a cutting wheel on the central mounting hub, whereby the unit is adapted to cut asphalt pavement or the like by rolling motion and down force of the cutting wheel.

Other and more specific objects and features of the invention herein will in part be apparent to those skilled in the art and will also in part be understood from the following description of the preferred embodiment in the claims, taken together with the drawings.

DRAWINGS

FIG. 1 a perspective view of a wheel compaction unit according to the invention herein mounted on the hydraulically-actuated articulated arm of an excavation machine and being used to compact fill in an excavated trench;

FIG. 2 is a front elevation view of the wheel compaction unit of FIG. 1;

FIG. 3 a side elevation view of the wheel compaction unit of FIG. 1;

FIG. 4 is a segmented, partially sectional side view of the wheel compaction unit of FIG. 1, showing the peripheral configuration;

FIG. 5 is a segmented view of the wheel compaction unit of FIG. 1, looking from the lines for 5—5 of FIG. 4;

FIG. 6 is a perspective, segmented view of a compaction foot on the periphery of the wheel compaction unit of FIG. 1, with a wear collar exploded therefrom;

The same reference numerals refer to the same elements throughout the various Figures.

DESCRIPTION OF PREFERRED EMBODIMENT

Figure 1:
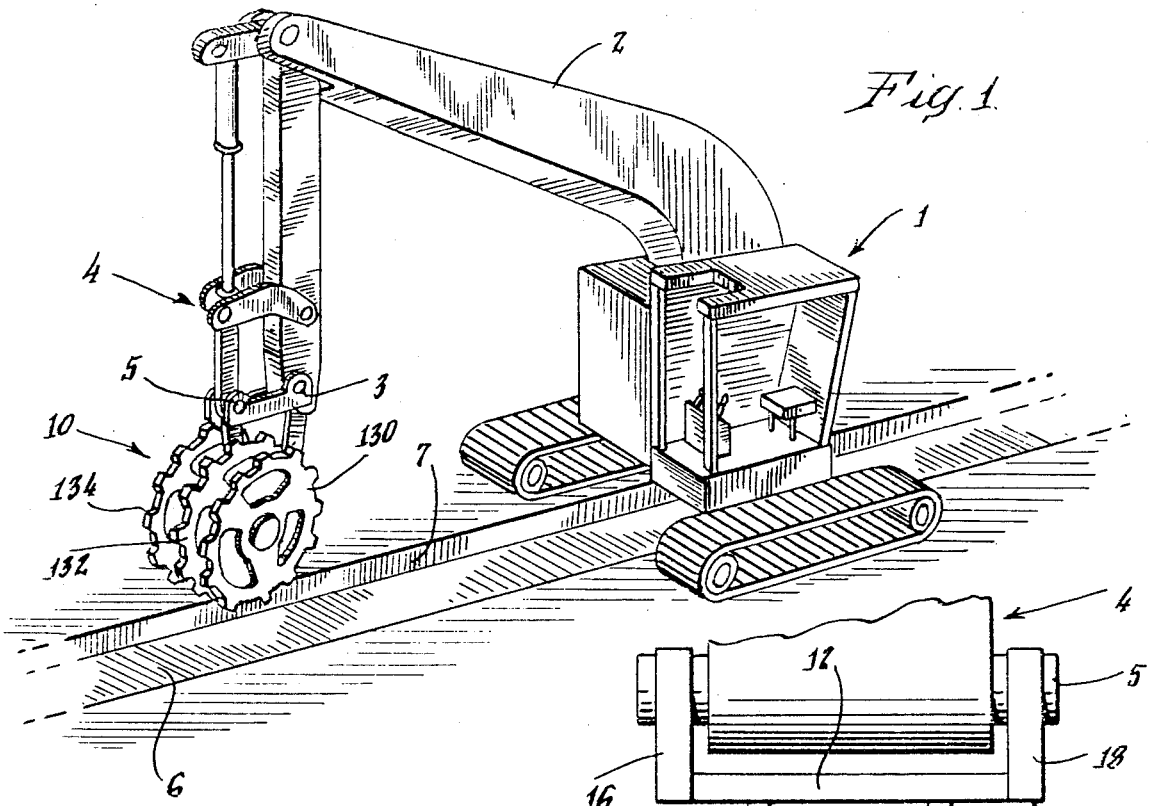
Figure 2:
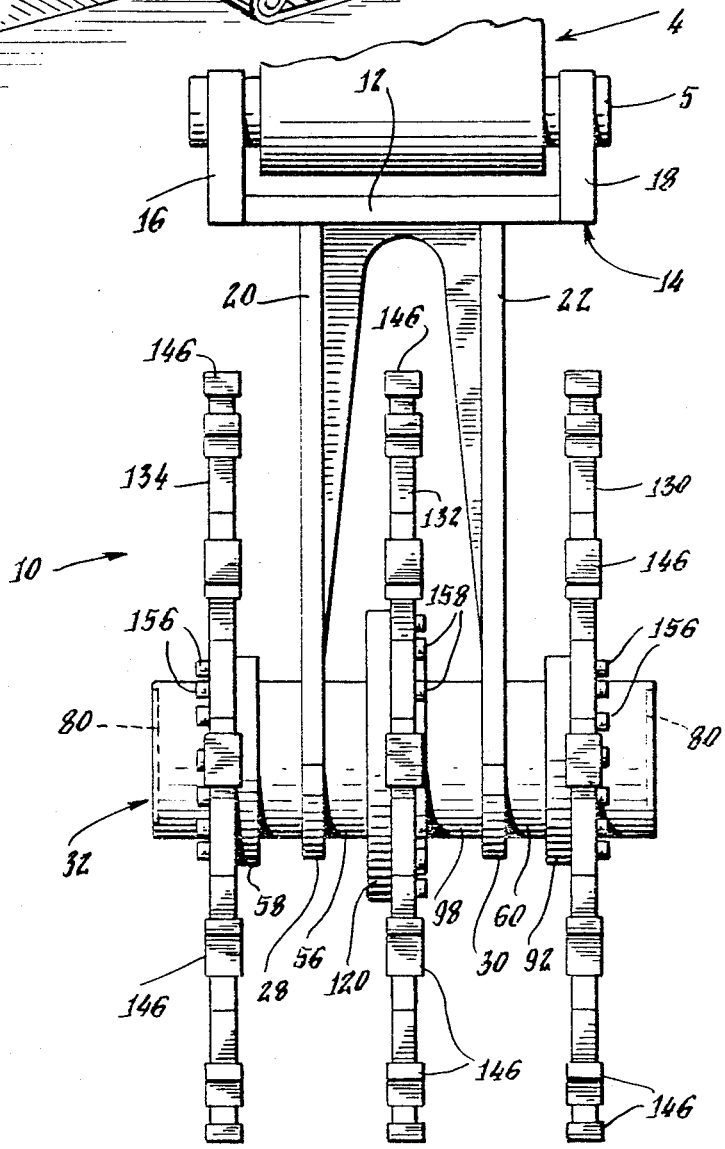

With reference to FIG. 1, a wheel compaction unit 10 according to the invention herein is shown mounted to the end of an articulated arm 2 of a heavy excavation machine 1. More particularly, the articulated arm 2 receives a mounting pin 3 at the end thereof, and is also provided with a hydraulically actuated wrist assembly 4 receiving a second mounting pin 5. The mounting pins 3 and 5 secure the base 12 of frame 14 of the wheel compaction unit 10 to the arm 2 and its wrist 4. With reference to FIGS. 1 and 2, the base 12 of frame 14 further comprises mounting plates 16 and 18 having openings therethrough for receiving the mounting pins 3 and 5 and thereby connecting the base 12 to the arm 2 and wrist 4.

Figure 7:
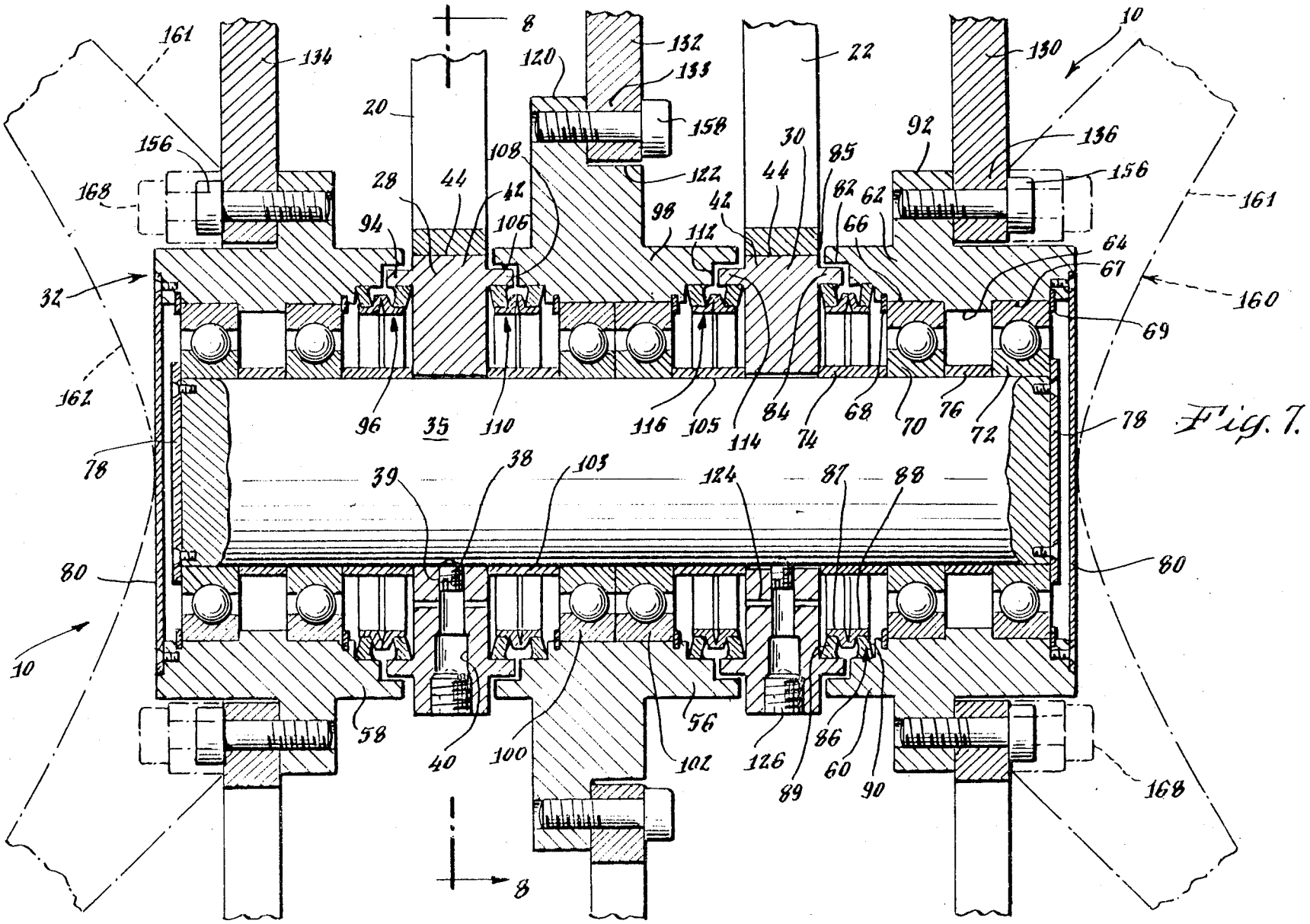
FIG. 7 is a sectional segmented view of the wheel compaction unit of FIG. 1, and particularly the axle and mounting hubs thereof, taken along the lines 7—7 of FIG. 3.
Figure 8:
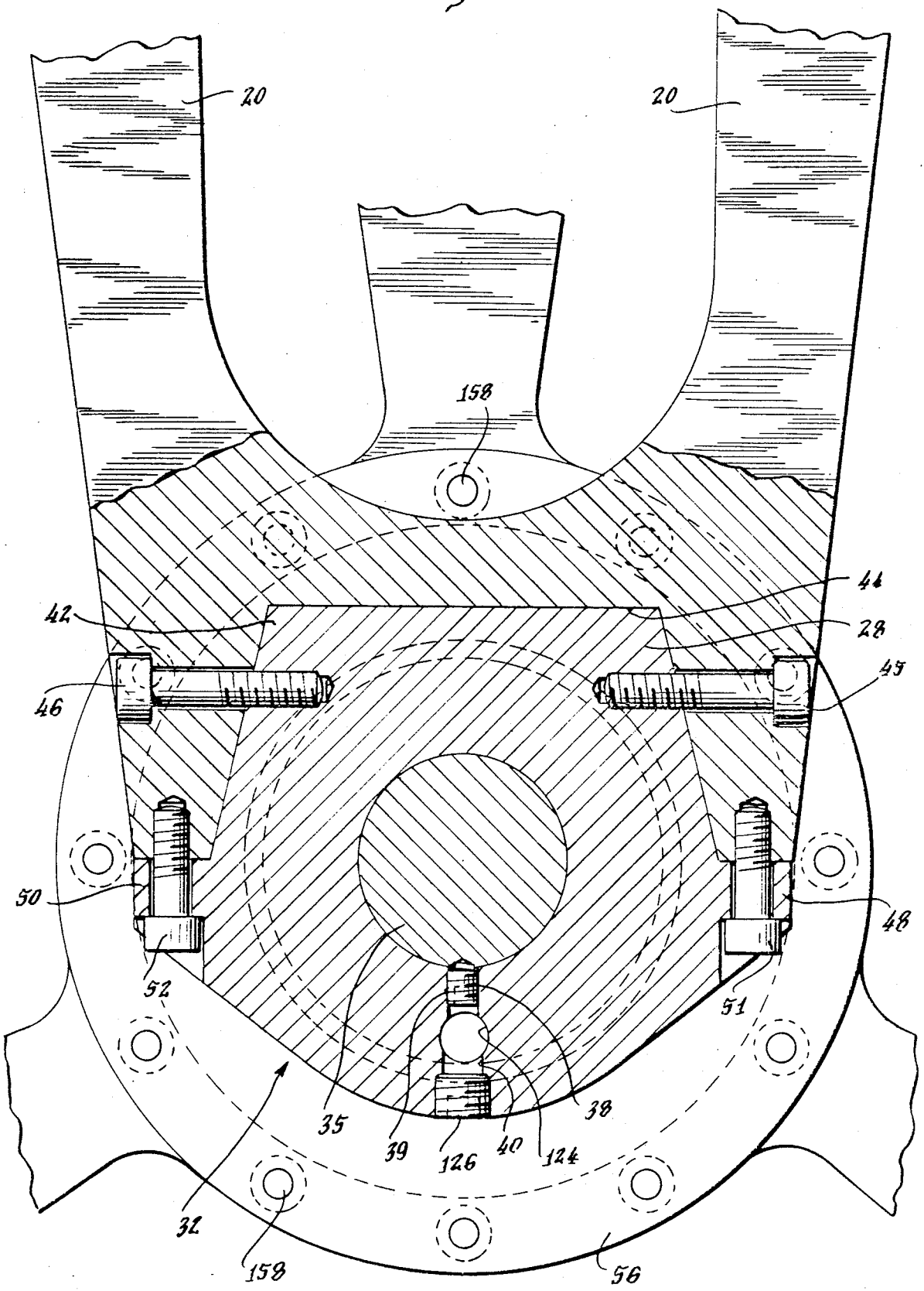
FIG. 8 is a sectional view of the wheel compaction unit of FIG. 1, taken along the lines 8—8 of FIG. 7.
Figure 9:
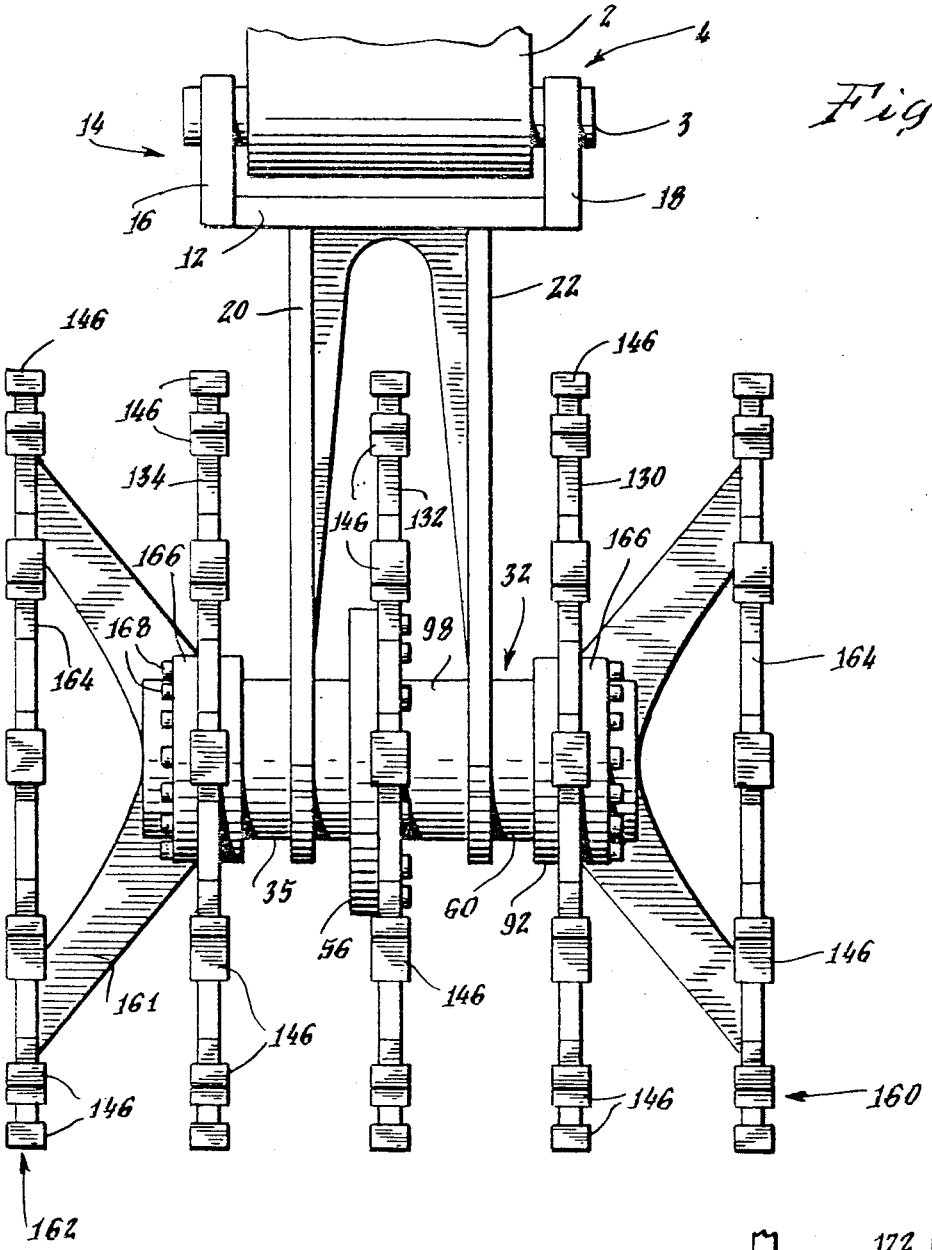
FIG. 9 is a front elevation view of the wheel compaction unit of FIG. 1, with outer compaction wheels attached.

The wheel compaction unit 10 further comprises a pair of support arms 20 and 22 extending outwardly from the base 12 of frame 14. The distal ends of the support arms 20 and 22 are adapted to receive mounting collars 28 and 30 of an axle and hub assembly 32. As best seen in FIGS. 7 and 8, the mounting collars 28 surrounds the axle 35 and is secured thereto by a set screw 38 working in the threaded end 39 of opening 40. The mounting collar 28 includes a mounting lug portion 42 which is received in a matingly-configured socket 44 on the end of support arm 20, and a pair of bolts 45, 46 secure the mounting arm and lug 42 together. The mounting collar 28 further comprises two ears 48 and 50 which are received on the ends of the mounting arm 20 and secured by bolts 51 and 52. The other mounting collar 30 is substantially identical and cooperates with and is secured to the other support arm 22 in the same manner.

With reference to FIG. 7, the mounting collars 28 and 30 are positioned on axle 35 with a central portion of the axle therebetween and with outer portions of the axle extending respectively therefrom. The axle and hub assembly 32 further comprises a central oil-sealed, bearing-mounted hub 56 and two outer oil-sealed, bearing-mounted hubs 58 and 60. Hub 60 has a generally cylindrical body portion 62 defining an inner annular surface 64 which is notched at 66 and 67 to accommodate the outer races of ball bearing assemblies 70 and 72, respectively. The outer bearing races are maintained against lateral movement by spring clips 68 and 69. The inner bearing races of bearing assemblies 70 and 72 surround the axle 35 and are maintained in position by annular spacers 74 and 76, spacer 74 abutting against the mounting collar 30, and by an end plate 78 secured to the end of axle 35 and having a slightly larger diameter so as to engage the inner bearing race of bearing assembly 72.

The space between the mounting hub 60 and the axle 35 is oil-filled for lubricating the bearings, and the oil in mounting hub 60 is contained by an end plate 80 which is removable to provide access for servicing or disassembling the axle and hub assembly 32. At the opposite end of mounting hub 60, the body 62 is provided with a notch 82 accommodating a ring flange 84 projecting from the mounting collar 30. Thus, there is a serpentine path 85 defined between the mounting hub 60 and the mounting collar 30 which resists the ingress of dirt. The joint between the mounting hub collar 30 and the mounting hub 60 is sealed against loss of lubrication and ingress of dirt by a ground metal seal 86 which is characterized by two ground metal rings 87 and 88 supported on two resilient legs 89 and 90 sealed, respectively, to the mounting collar 30 and the mounting hub 60. The grind on the metal rings 87 and 88 is such that a small amount of lubricant is continuously drawn therebetween, thereby lubricating the metal rings and also further resisting the ingress of dirt. Suitable ground metal seals are available from Chicago Rawhide Corporation.

The mounting hub 60 has a radially-extending mounting flange 92, to which is bolted one or more compaction wheels, as more fully discussed below. The mounting hub 58 is the same as mounting hub 60, except, of course, being reversed in direction on the axle 35 so as to receive and accommodate the ring flange 94 extending from mounting collar 28 and to be sealed with the mounting collar 28 by the ground metal seal 96.

The central mounting hub 56 is similar to the outside mounting hubs 58 and 60, including a cylindrical body 98 supported on two bearing assemblies 100 and 102. The bearing assemblies are maintained in position by annular spacers 103 and 105 surrounding the axle 35, the spacers 103 and 105 abutting against the mounting collars 28 and 30, respectively. The cylindrical body 98 is notched at 106 to accommodate ring flange 108 extending from mounting collar 28, and a ground metal seal 110 is provided between the mounting collar 28 and the mounting hub 56. Thus, both a serpentine entry path and the seal resist contamintion of the lubricant. Similarly, the opposite end of body 98 is notched at 112 to accommodate ring flange 114 extending from the mounting collar 30, and ground metal seal 116 is provided between the central mounting hub 56 and mounting collar 30.

The central hub 56 includes a radially-extending mounting flange 120 for mounting compaction wheels, and the like, as more fully discussed below. However, it should be noted that the flange 120 includes an elevated shoulder 122 having a diameter larger than the diameter of the radial mounting flange 92 of the outside mounting hub 60.

With reference to both FIGS. 7 and 8, the mounting collars 28 and 30 also provide for filling the axle and hub assembly 32 with oil. The mounting collar 30 is cross-drilled with an opening 124 intersecting the opening 40, whereby the openings 40 and 124 provide an oil passageway into the sealed space between the axle and mounting hubs. Oil may be introduced to the space through the openings 40 and 124, and an oil plug 126 is provided to block the opening 40 once the fill operation is completed. The openings and plug are duplicated in the mounting collar 28, in order to fill the space between the outside mounting hub 58 and the axle 35.

Figure 3:
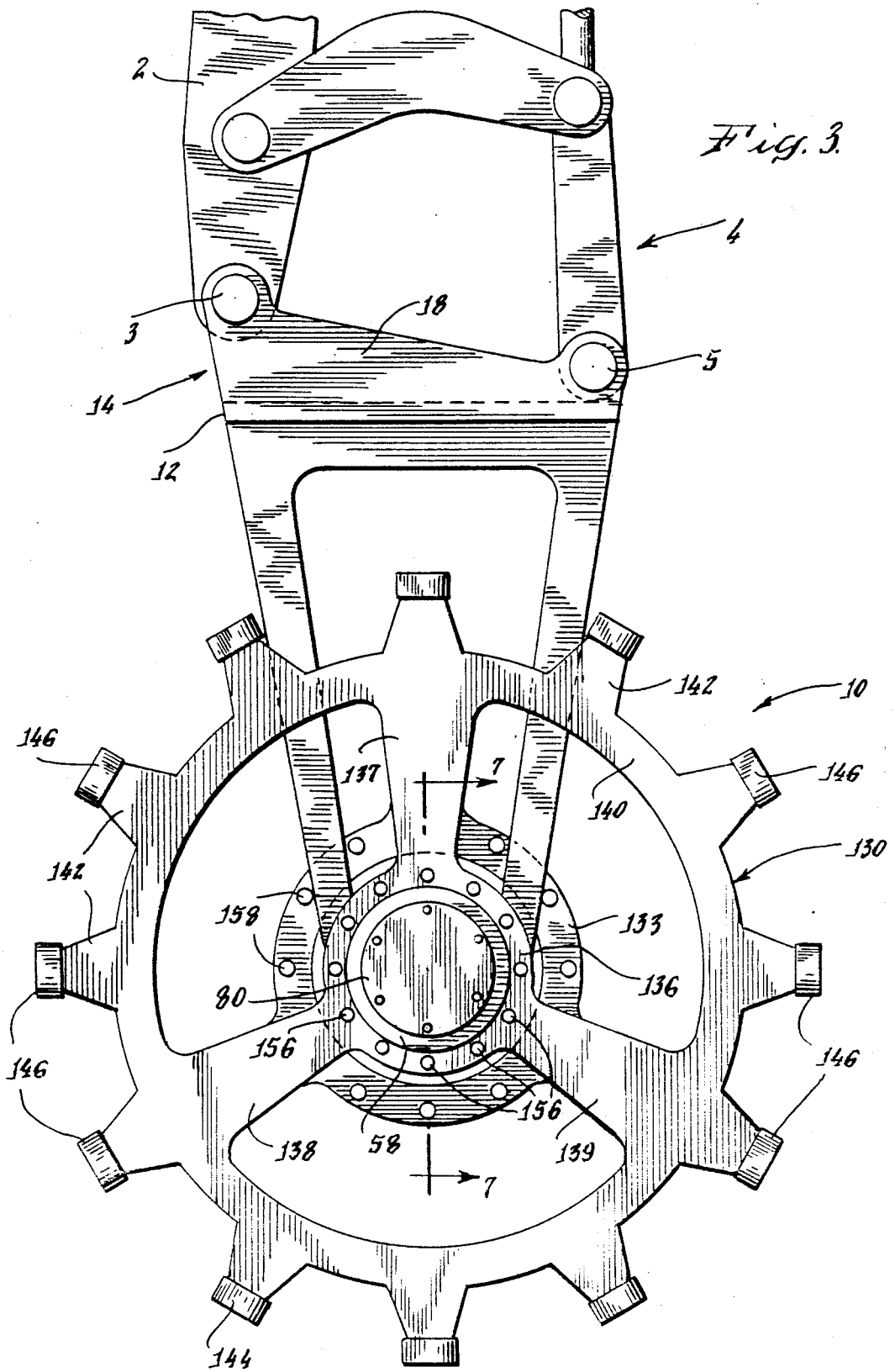

The wheel compaction unit 10 further comprises compaction wheels 130, 132 and 134 respectively mounted on the mounting hubs 58, 56 and 60. As best seen in FIG. 3, the compaction wheel 130 comprises a central mounting ring 136, and radially-extending spokes 137, 138 and 139 connecting the mounting ring 136 with a rim 140. Extending outwardly from the rim 140 are a plurality of spaced-apart trapezoidal presentation supports 142 having compaction feet 144 thereon, which, together with the connecting rim portions, form the periphery of the compaction wheel. Each of the compaction feet is provided with a wear collar 146. The detail of the wheel rim, presentation supports, compaction feet and wear collars is illustrated in FIG. 4–6. With reference to those Figures, the presentation supports include leading/trailing edges 148, 150 (the leading or trailing descriptor depending upon the direction of rotation) which define an angle "A" with respect to radii of the wheel, the angle "A" preferably being approximately 30 degrees. The compaction feet 144 are rectangular, and have a height "H" which is approximately one-half the height of the presentation supports and also approximately one-half of the length "L" of the compaction feet. With particular reference to FIG. 5, the compaction feet also have a rectangular sole 152. The compaction feet are fitted with wear collars 146, the wear collars preferably comprising a length of rectangular tubing sized for a tight friction fit over the compaction feet. The wear collars have a height "C" which is slightly greater than the height "H" of the compaction foot, wherein the soles of the compaction feet are recessed.

During operation of the wheel compaction unit 10, the wear collars 146 are primarily subjected to the abrasion and impact inherent in a compacting process, protecting the compaction feet 144 themselves from such abuse. The protection is enhanced by the recessed soles, wherein the recesses fill with dirt and minimizes wear of the soles. The wear collars are readily replaceable in the field with use of very simple tools, e.g. a hammer, with which a worn wear collar may be knocked off and a fresh wear collar driven onto a compaction foot, as best illustrated in FIG. 6.

In the preferred embodiment shown, the compaction wheel 130 is integrally fabricated of 1½ inch thick plate steel and has a diameter of approximately five (5) feet, exclusive of the wear collar projection. The height of the presentation supports is approximately 4 inches and the height of the compaction feet, exclusive of the wear collar, is two inches. The length "L" of the compaction foot is 3½ inches. The wear collar is ¼ inch thick wall rectangular tubing, having a height "C" of 2½ inches so as to project over the compaction foot by ½ inch, prior to wear. The inside opening of the wear collar achieves a strong friction fit with the compaction foot.

The center compaction wheel 132 is similar to the outside compaction wheels 130 and 134, except that its mounting ring 133 has a larger inside diameter sized to fit over the shoulder 122 of the central hub mounting flange 120, as best seen in FIGS. 3 and 7.

With continued reference to FIGS. 3 and 7, the compaction wheels 130, 132 and 134 mount to the radial flanges of the hubs of the axle and hub assembly 32. More particularly, the mounting ring 136 of compaction wheel 130 fits over the outside hub 60 adjacent the flange 92, and bolts 156 are used to secure the wheel to the flange. Prior to mounting the compaction wheel 130, the compaction wheel 132 is mounted to the center hub 56 by passing the larger diameter mounting ring 133 over the flange 92. The mounting ring 133 is secured to the flange 120 by bolts 158. The other outside compaction wheel 134 is similarly mounted. It will be appreciated that the axle and hub assembly 32 is removed from the frame 14 in order to mount the central compaction wheel 132 and that this is accomplished by removing the mounting collars 28, 30 from the support arms 20, 22 but by not otherwise disassembling the axle and hub assembly 32.

Figure 10:
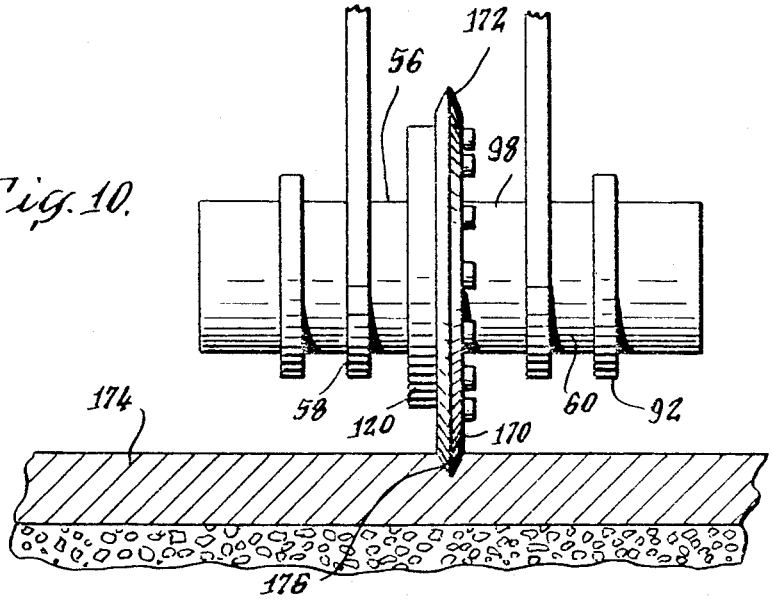
FIG. 10 is a front elevation view of the wheel compaction unit of FIG. 1 showing a cutter wheel installed on the central hub thereof.

When mounted, the outside compaction wheels 130, 134 are approximately 24 inches apart, whereby the wheel compaction unit 10 is well adapted for working in excavated trenches as narrow as two feet wide. With reference to FIGS. 10 and the dotted portion of FIG. 7, auxiliary compaction wheels 160 and 162 may also be mounted to the outside mounting hubs 58 and 60 in order to increase the working width of the wheel compaction unit. The auxiliary compaction wheel 160 comprises a rim 164 having a peripheral configuration including presentation supports, compaction feet and wear collars as described with respect to the other compaction wheels. A mounting ring 166 is mounted to the mounting hub 60 together with the mounting ring 136 and compaction wheel 130 by use of longer bolts 168, as illustrated in FIG. 7. The parts and mounting of the other auxilliary compaction wheel 162 are the same. The spokes 161 of the auxiliary compaction wheel 160 provide an offset between the mounting ring 166 and the peripheral rim 164, whereby the space between the peripheral rim 164 and the periphery of the adjacent compaction wheel is approximately the same spacing as found between the other compaction wheels. Thus, in the embodiment shown, the overall working width of the wheel compaction unit is increased to approximately forty-six inches with the addition of the auxiliary compaction wheels 160 and 162.

The wheel compaction unit 10 is used by attaching it to the hydraulically actuated articulated arm 2 of heavy excavating equipment 1, as illustrated in FIG. 1. The arm 2 is manipulated to apply substantial down pressure to the wheel compaction unit and to roll the wheel compaction unit back and forth over fill 6 placed in the excavated trench 7. The efficiency of the wheel compaction unit 10 is enhanced by several factors, including the amount of pressure that can be applied to the unit, the peripheral configuration of the compaction wheels and the independently rotatable action of the wheel compaction wheels. The angle on the leading/trailing edges of the presentation supports permits the compaction feet to enter and exit the fill with a minimum disruption or digging of the fill, which is important because any such digging tends to loosen rather than compact the fill and hence defeat the efficient operation of a wheel compaction unit. Wheel compaction units of the type having elongated radially-extending sheeps foot compaction elements suffer from this disadvantage. The independent rotatable operation of the compaction wheels also contributes to the overall efficiency of the wheel compaction unit 10. In particular, in the event one of the compaction wheels is obstructed from free rotation, such as by a piece of debris wedging between the wheel and the support arms, the other wheels are free to continue rotating independently rather than becoming locked in position and dragging through the fill, which also defeats efficient compaction. The axle and mounting hub structure which permits the independent rotation of the compaction wheels is also adapted to transmitting substantial pressures through the support arms to the compaction wheels and to resisting the ingress of dirt which would shorten the life of the unit or at the minimum require frequent maintenance. As the wear collars become worn or damaged, they are easily replaced with minimum down time.

The versatility of the wheel compaction unit 10 is further enhanced by provision of an alternate cutting wheel 170, which is illustrated in FIG. 10 being mounted to the central mounting hub 56 in place of a compaction wheel. The other compaction wheels are also removed during use of the cutting wheel 170. The cutting wheel 170 is characterized by a sharpened, hardened steel perimeter 172. When the cutting wheel 170 is rolled over pavement 174 the sharp perimeter 172 forms a groove 176 in the pavement, eventually cutting through the pavement 174. Thus, the cutting wheel 170 may be used to neatly remove pavement above an excavation site, and this is accomplished more efficiently and quickly than by deploying personnel with pneumatic hammers.

The wheel compaction unit 10 described above is a preferred embodiment of the invention and is illustrative thereof. It will be appreciated that various changes and modifications may be made by those skilled in the art without departing from the spirit and scope of the invention, which is limited only by the following claims.

I claim:

1. In a wheel compaction unit of the type generally comprising a plurality of compacting wheels mounted to an axle and frame, the compacting wheels including spaced-apart, radially outwardly protruding compacting feet each having a compacting sole surface, the improvement comprising a wear collar removably mounted closely surrounding each compaction foot, the wear collar defining an opening therethrough sized and shaped to fit over and surround the compacting foot, leaving the compacting sole of the compacting foot exposed while protecting the portions of the compacting foot adjacent the compacting sole surface, whereby the wear collar sustains substantially all of the abrasion, impact, damage and wear inherent in the compaction operation and is replaceable.

2. An improvement in a wheel compaction unit as defined in claim 1 wherein the wear collar extends radially outwardly beyond the sole surface of the compaction foot, thereby providing a recessed space which often receives and retains fill material which protects the sole surface from abrasion.

3. An improvement in a wheel compaction unit as defined in claim 2 wherein the wear collar is maintained on the compaction foot by a friction fit.

4. An improvement in a wheel compaction unit as defined in claim 3 wherein the compaction foot is rectangular and has a width substantially the same as the width of the wheel.

5. An improvement in a wheel compaction unit as defined in claim 1 wherein the wear collar is maintained on the compaction foot by a friction fit.

6. An improvement in a wheel compaction unit as defined in claim 1 wherein the compaction foot is rectangular and has a width substantially the same as the width of the wheel.

7. In a wheel compaction unit of the type generally comprising a plurality of compacting wheels mounted to an axle and frame, the improvement comprising a compaction wheel integrally fabricated of plate steel and having a periphery configuration characterized by a plurality of spaced-apart compaction feet each deployed on the distal end of a presentation support extending from a circular rim portion of the wheel, each presentation support having angled leading/trailing presentation surfaces and the compaction foot having a height approximately on half the height of the presentation support, and the compaction foot having a rectangular compaction sole surface.

8. An improvement in a compaction wheel unit as defined in claim 7 wherein the angle of the leading/-trailing presentation surfaces is approximately 30° with respect to a radius of the compaction wheel.

9. An improvement in a wheel compaction unit as defined in claim 7 and further comprising a wear collar removably mounted closely surrounding each compaction foot.

10. A wheel compaction unit comprising:

A. a frame including a base adapted for connection to the articulated arm of heavy excavation equipment or the like, the frame including at least two support arms extending outwardly from the base;

B. an axle;

C. means mounting the axle on the distal extending ends of the support arms with a central portion of the axle between the support arms and outer portions of the axle respectively extending outwardly from the support arms;

D. central and outer oil-sealed, bearing mounted hubs respectively mounted on the central and outer axle portions for independent rotation thereon; and E. a compaction wheel removably mounted to each of the central and outer hubs, the compaction wheels including a plurality of compaction feet deployed about the periphery thereof, wherein the hubs include radially extending mounting flanges and the compaction wheels include mounting rings which are removably mounted to the mounting flanges of the hubs, and the mounting flange of the central hub has a shoulder of larger diameter than the mounting flange of at least one of the outer hubs and the center compaction wheel has an opening accommodated on the shoulder of the central hub mounting flange, whereby the central compaction wheel may be passed over the outer hub mounting flange for mounting to the center hub.

11. A wheel compaction unit comprising:

A. a frame including a base adapted for connection to the articulated arm of heavy excavation equipment or the like, the frame including at least two support arms extending outwardly from the base;

B. an axle;

C. means mounting the axle on the distal extending ends of the support arms with a central portion of the axle between the support arms and outer portions of the axle respectively extending outwardly from the support arms;

D. central and outer hubs respectively mounted on the central and outer axle portions, the outer hubs being adapted to alternatively mount one or two compaction wheels;

E. a compaction wheel removably mounted to each of the central and outer hubs, the compaction wheels including a plurality of compaction feet deployed about the periphery thereof; and F. two auxiliary compaction wheels having central mounting rings respectively mounted to each of the outer mounting hubs, the auxiliary compaction wheels having angled spokes to offset their peripheries from their mounting rings and away from their respective outer mounting hubs when the auxiliary wheels are mounted thereon, thereby also providing their compaction feet spaced apart from the compaction feet of the compaction wheels already mounted to the outer hub.

* * * * *